US005620362A

United States Patent [19]

Kuehn

[11] Patent Number: 5,620,362

[45] Date of Patent: Apr. 15, 1997

[54] SHOT BLAST MACHINE WITH HOLD DOWN FOR PARTS BEING DEFLASHED

[75] Inventor: Udo Kuehn, Holland, Ohio

[73] Assignee: B&U Corporation, Adrian, Mich.

[21] Appl. No.: 610,374

[22] Filed: Mar. 4, 1996

[51] Int. Cl.[6] ..... B24C 3/14

[52] U.S. Cl. ..... 451/81; 451/91; 451/97

[58] Field of Search ..... 451/38, 75, 80, 451/81, 91, 95, 96, 97, 336

[56] References Cited

U.S. PATENT DOCUMENTS

| | | | |
|---|---|---|---|
| 4,164,103 | 8/1979 | Hesse et al. | 451/95 |
| 4,793,103 | 12/1988 | Baumgart | 451/81 |
| 5,182,882 | 2/1993 | Brodene et al. | 451/81 |
| 5,417,608 | 5/1995 | Elliott | 451/81 |

FOREIGN PATENT DOCUMENTS

| | | | |
|---|---|---|---|
| 532245 | 8/1931 | Germany | 451/81 |

*Primary Examiner*—Eileen Morgan
*Attorney, Agent, or Firm*—Harness, Dickey & Pierce, P.L.C.

[57] ABSTRACT

A shot blast machine for deflashing plastic molded parts in which a substantially horizontal conveyor belt is used for delivering the parts to be deflashed. Shot blasting wheels are located above the conveyor belt and impel particles downward into deflashing engagement with plastic parts on the conveyor. A wire mesh member, in the form of an endless belt, is positioned above and in close proximity to the conveyor belt so that parts being blasted are trapped and held between the wire mesh belt and the conveyor belt. The wire mesh belt prevents the parts being deflashed from being moved off the conveyor belt under the influence of blasting particles. The hold down belt is also movably mounted above the conveyor belt so that it can float up and down and accommodate parts of different sizes.

8 Claims, 4 Drawing Sheets

SHOT BLAST MACHINE WITH HOLD DOWN FOR PARTS BEING DEFLASHED

BACKGROUND AND SUMMARY OF THE INVENTION

This invention relates generally to the field of shot blasting and more particularly to a shot blast machine for deflashing thermoset molded plastic parts.

Many industrial parts that are made of plastic can be molded and substantially deflashed with abrasive particles that are projected at the parts. A system that uses abrasive particles thus lends itself to continuous operation and is advantageous because of its efficiency. This further eliminates manual deflashing and provides for an increased production relative to typical batch systems. The result is a higher capacity than other deflashing systems.

The machine of this invention provides a hold down assembly which cooperates with a continuous endless conveyor belt. The hold down is required for light and small parts, since the kinetic energy created by the blast stream of particles will move the parts on the belt and thereby fail to provide the correct exposure time of the parts to the particle stream for deflashing. The hold down assembly includes a wire mesh member which keeps the plastic molded parts on the conveyor while abrasive particles are propelled through the wire mesh to deflash the parts. In this manner, the present system eliminates the moving of parts and provides high production in a controlled process to thereby achieve a continuous finishing of the plastic molded parts. Furthermore, the system is ideally suited for handling larger parts that cannot be tumbled and smaller, fragile parts that are prone to breakage or nicking.

The machine of the present invention thus includes a continuous, variable speed conveyor system in conjunction with a hold down assembly to provide non-stop deflashing via a centrifugal blasting system with variable speed centrifugal blast wheels that thoroughly blast the parts. An adjustable blow off system can also be employed to remove light or medium amounts of carryout abrasive particles. A polyamid/polycarbonate blasting media is preferred as the abrasive particles since it causes virtually no surface alterations on the plastic parts while still providing sufficient mass for the deflashing process. This simple yet rugged construction of machine assures minimal and easy maintenance and repairs.

Further features and advantages of the blast machine of this invention are as follows:

A. The wire mesh member, in the form of an endless belt, is provided generally parallel to the conveyor belt and functions to hold down or press light weight parts on the conveyor belt so that the parts will not slide off the conveyor belt.

B. The wire mesh belt and the conveyor belt are synchronized in their speeds of travel so that speed differences will not result in the creation of scratch marks on the plastic parts. Scratch marks can result if the parts roll or slide relative to either of the belts.

C. The drive system for the hold down belt is connected to the drive system of the conveyor belt via gearboxes or chains. This assures synchronized movement of the belts.

D. The wire mesh belt is made of a low density mesh so that the blast wheels can project the blast media through the wire mesh and into engagement with the parts to be deflashed on the conveyor below.

E. The mesh or hold down belt is "floating". Stated otherwise, it is mounted in the machine so it can move up and down relative to the conveyor belt to thereby accommodate parts of different thicknesses.

Further objects, features and advantages of the invention will become apparent to those skilled in the art from a consideration of the following description and the appended claims, when taken in connection with the accompanying drawings.

DETAILED DESCRIPTION OF THE PREFERRED EMBODIMENT

Figure 1:
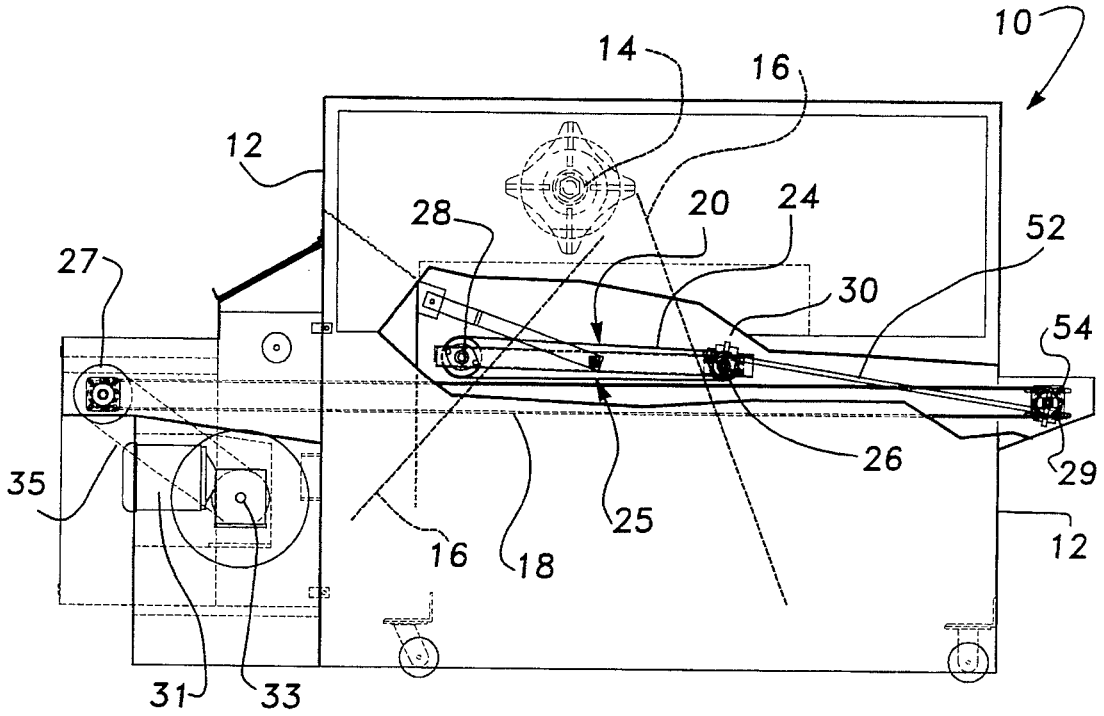
FIG. 1 is a side elevational view of a blast machine according to the present invention.

With reference to the drawing, the blast machine of this invention is indicated generally at 10 in FIG. 1. The blast machine 10 is comprised of a main frame 12, a blast wheel 14, a conveyor belt assembly 18 and a hold down assembly 20. The blast wheel 14 is of conventional construction and impels abrasive plastic particles in stream 16 toward the generally horizontal conveyor belt assembly 18 while the hold down assembly 20, which includes an endless, wire mesh belt 24 positioned in the machine 10 above the conveyor belt 18 and below the blast wheel 14, holds down or retains plastic parts 22 to be deflashed on an endless belt 25 of the conveyor assembly 18.

Figure 5:
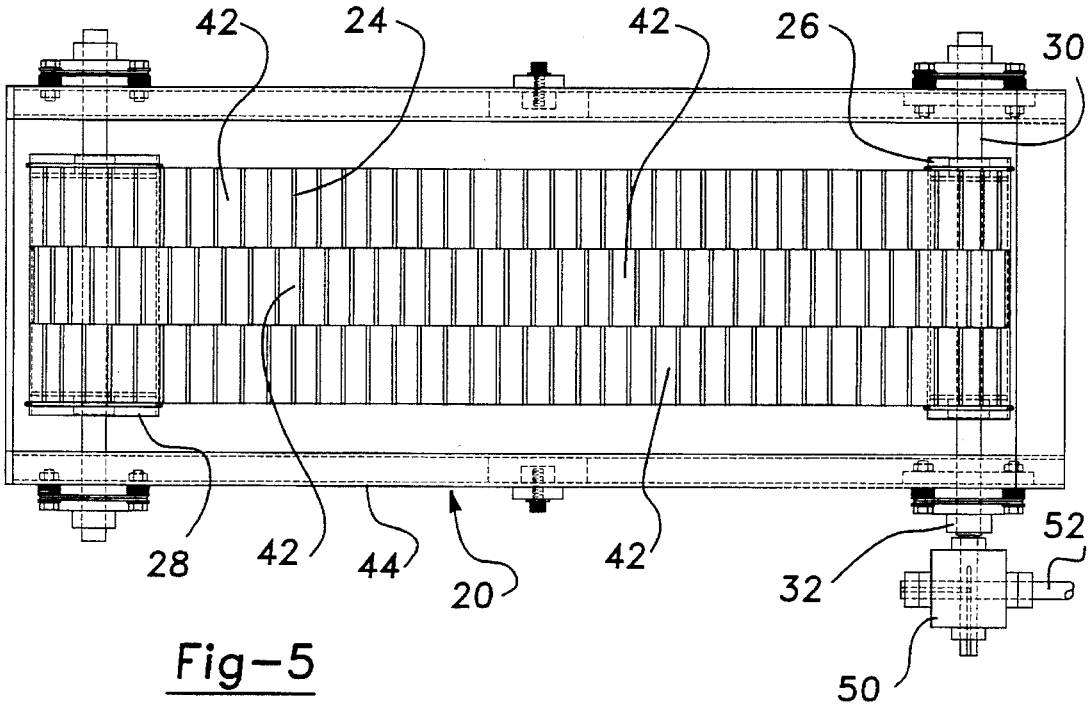
FIG. 5 is a top view of the wire mesh belt and the movable support frame therefor in the machine of this invention.
Figure 6:
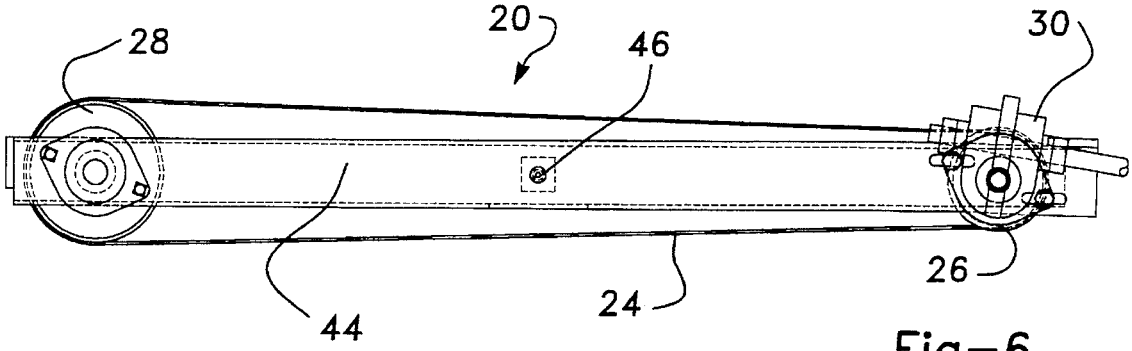
FIG. 6 is a side view of the assembly shown in FIG. 5.

As particularly shown in FIGS. 5 and 6, the hold down assembly 20 includes an endless wire mesh belt 24 which is rotatably mounted on a drive pulley 26 at one end and a larger pulley 28 at the opposite end, both of which are supported by a frame 44. The drive pulley 26 is driven by a gear box 50 located on the shaft 30 for the pulley 26. The gear box 50 is connected via a shaft 52 to the gear box 54 for the conveyor 18. As indicated in FIG. 5, the wire mesh belt 24 is shown as having mesh density that provides a multitude of large openings 42 for the particles in the stream 16 to pass therethrough and impact the parts 22 located below.

The conveyor assembly 18 includes an endless belt 25 on which the parts 22 to be deflashed are supported during movement through the machine 10. The conveyor belt 25 is positioned about a pair of end pulleys 27 and 29 and driven by a motor 31 whose output shaft 33 causes movement of a belt 35 connected with the pulley 27 (FIG. 1). In use, the top section of the belt 18 moves to the right as viewed in FIG.

4*b* and indicated by the arrow 40. Additionally, the endless conveyor belt 25 extends longitudinally beyond both ends of the hold down assembly 18 as generally defined by the pulleys 27 and 29. Those portions of the conveyor belt 25 which extend beyond the ends of the wire mesh belt 24 are respectively referred to and used as an inlet section 36 and a discharge section 38 of the conveyor assembly 18.

Figure 2:
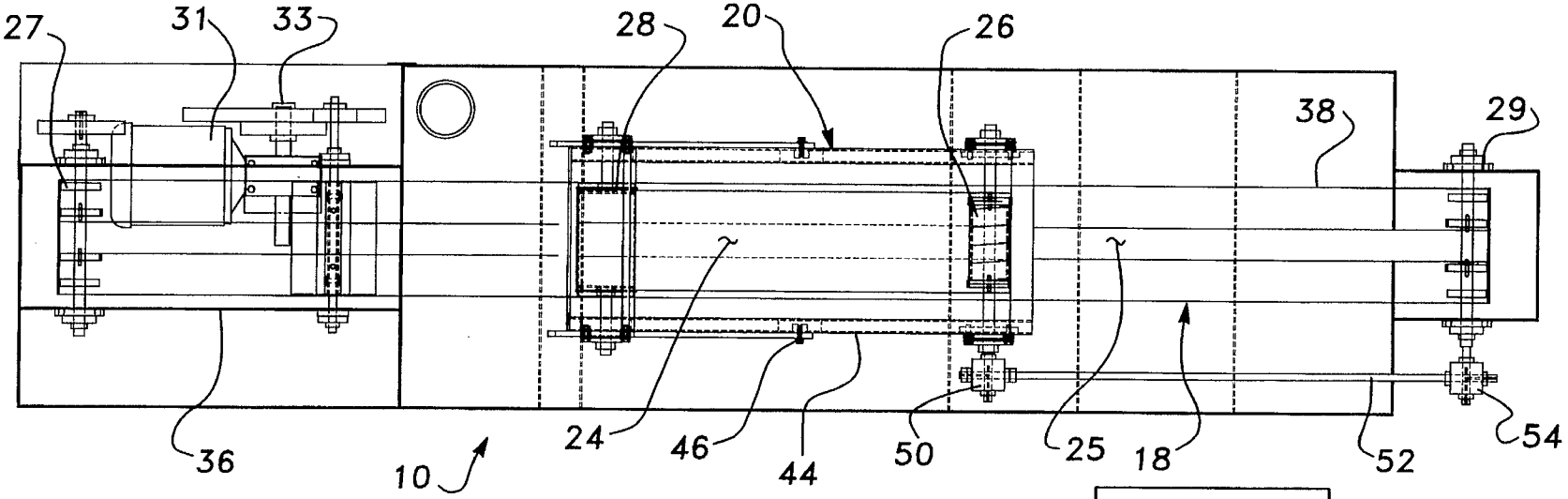
FIG. 2 is a top view of the machine shown in FIG. 1, with some parts removed for purposes of clarity.
Figure 3:
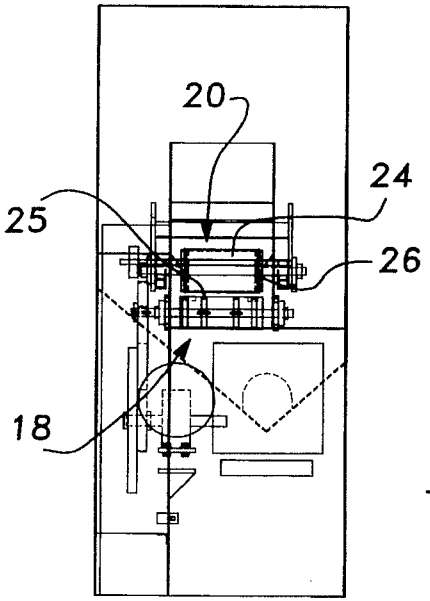
FIG. 3 is an end view of the blast machine of this invention.

As illustrated in FIG. 2, the connector shaft 50 extends between the gear box 52 of the hold down assembly 20 and the gear box 54 for the conveyor assembly 18. This connection of the two assemblies 18 and 20 synchronizes the wire mesh belt 20 so that it moves at the same speed of travel as the conveyor belt 25. Obviously, other mechanical and non-mechanical mechanisms can be used for synchronization of the belts 24 and 25, including a controller synchronizing separate drive motors (not shown).

Figure 4A:
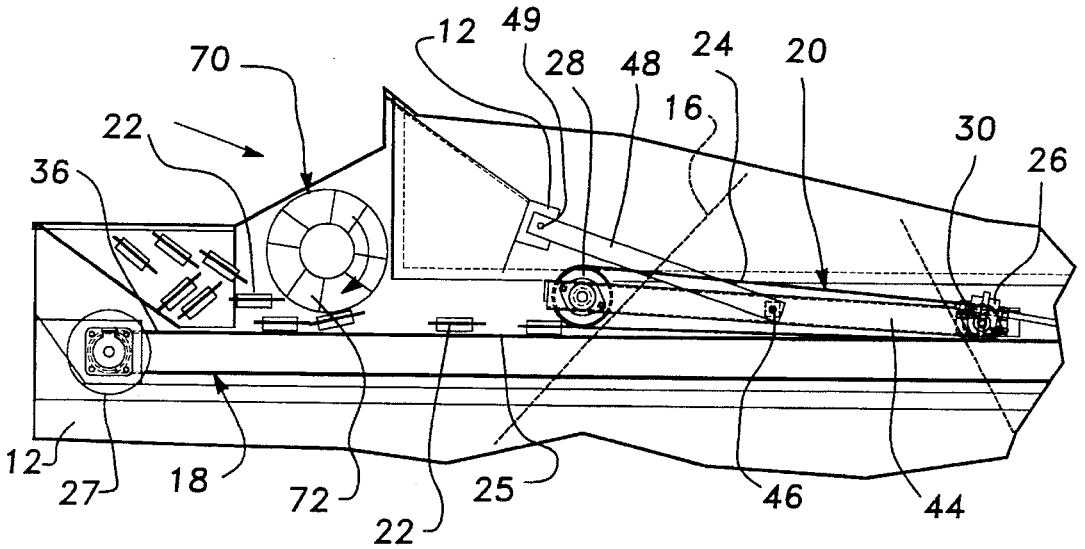
FIG. 4*a* is a fragmentary side view of the machine with the wire mesh belt in position prior to engagement of parts to be deflashed with the belt.
Figure 4B:
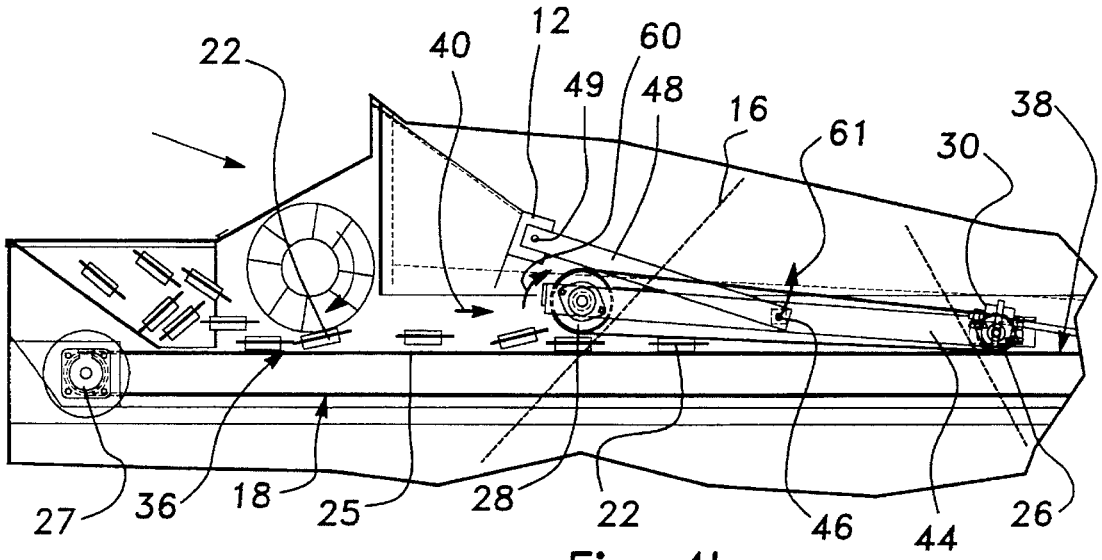
FIG. 4*b* is a fragmentary side view like FIG. 4*a* showing the wire mesh belt as it begins to lift to accommodate parts moving on the conveyor belt.
Figure 4C:
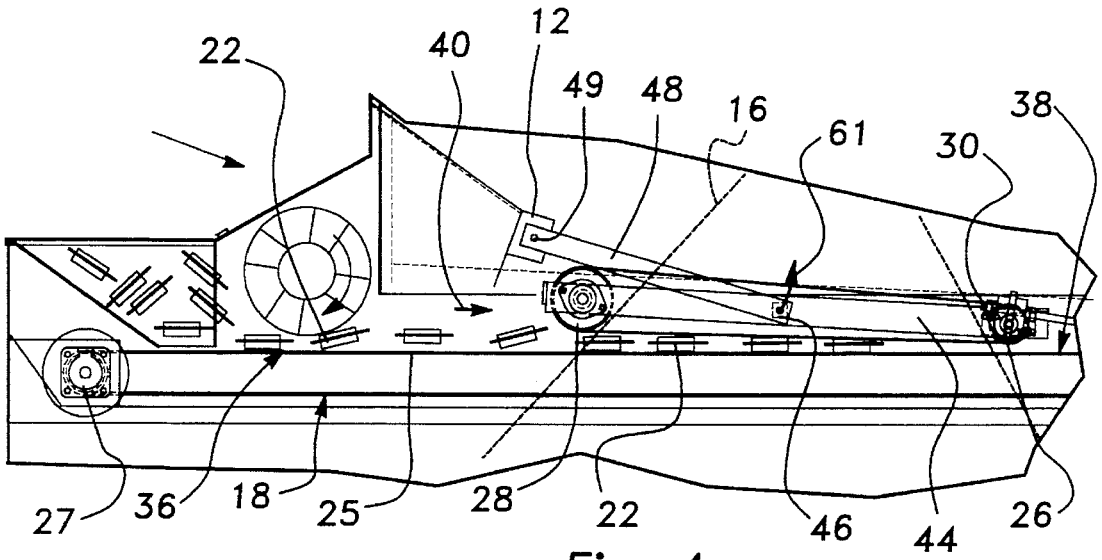
FIG. 4*c* is a fragmentary view of the blast machine of this invention showing the wire mesh belt in the lifted position where it continuously accommodates and holds down parts on the conveyor belt.

Referring now to FIGS. 4*a*–4*c*, parts to be deflashed are deposited on the inlet section 36 of the conveyor belt 18. The frame 44 of the hold down assembly 20 is pivotably supported at horizontal pivot members 46 by a pair of arms 48 that are in turn pivotally mounted at 49 to the main frame 12 at a point downstream from the belt inlet section 36. The mounting of the frame 44 and assembly 20 to the ends of the arms 48 generally at a midway point on the frame 44 between the pulleys 26 and 28 and enables the hold down assembly 20 to "float" or move up and down relative to the conveyor assembly 18. This floating allows for the accommodation of various sized parts 22 as they pass between the upper flight of the conveyor belt 25 and the lower flight of the wire mesh belt 24.

As shown in FIG. 4*a*, the parts 22 to be blasted and deflashed are advanced by conveyor belt 25 to a position where they initially engage the wire mesh belt 24. Movement of the conveyor belt 25 in the direction of arrow 40 acts on the parts 22 to move the parts 22 under the lead pulley 28 of the assembly 20. This initial engagement of the parts 22 with the lower flight of the wire mesh belt 24 causes this end of the assembly 20 to pivot upwardly, as indicated by the arrow 60 in FIG. 4*b*. As the parts 22 continue to move from left to right, while being held down by the wire mesh belt 24, the middle section (generally at pivot 46) of the assembly 20 and its trailing end (generally at the drive wheel 26) move upward, as indicated by arrow 61, relative to the conveyor belt 25 and in response to the presence of the parts 22.

While between the belts 24 and 18, the parts 22 are readily subjected to the blasting action of the abrasive plastic particles in the stream 16 from the blast wheel 14. This blasting and deflashing continues as the parts 22 advance toward the discharge section 38 of the conveyor belt 25. This process is continuous as a media conveying element (not shown) operates to convey the blast particles from positions below the conveyor belt 25 to the blast wheel 14 for discharge into the stream 16. In this manner, the process performed by the present invention can continuously deflash parts 22 over a prolonged period of operation.

It is thus been seen that in the blast machine 10 of this invention, the parts 22 to be deflashed are held on the conveyor belt 18 by the wire mesh belt assembly 24 to assure complete deflashing of the parts 22 as they move beneath the blast wheel 14 and toward the discharge end 38 of the conveyor belt 18. The resulting continuous process is efficient and reliable at deflashing since all of the parts are held beneath the blast wheel 14 and cannot be moved off of the conveyor belt 18 as a result of impact with the abrasive particles in the stream 16.

A parts separator 70 (FIG. 4*a*) eliminates the layering of parts 22 on the parts conveyor 18. This eliminates the resulting mashing of parts by each other. The separator 70 includes brushes 72 which push the upper layers of parts backward until the space on the conveyor 18 allows a proper deposit.

It is to be understood that the invention is not limited to the exact construction illustrated and described above, but that various changes and modifications may be made without departing from the spirit and scope of the invention as defined in the following claims.

I claim:

1. A shot blast machine for deflashing plastic molded parts comprising:

substantially horizontal conveyor means for delivering parts to be deflashed, shot blast means located above said conveyor means for impelling particles downwardly into deflashing engagement with parts on said conveyor means, a wire mesh member above said conveyor means and below said shot blast means to retain parts on said conveyor during deflashing, and mounting means for mounting said wire mesh member so that it moves at generally the same speed as said conveyor means and so that it engages said parts to retain the parts on said conveyor means.

2. The shot blast machine according to claim 1 wherein said conveyor means includes an endless conveyor belt, said wire mesh member constituting an endless hold down belt having a portion substantially parallel to said conveyor belt, drive means for each of said belts, and means for controlling said drive means so that the speed of said hold down belt is synchronized with the speed of said conveyor belt.

3. The shot blast machine according to claim 2 wherein said conveyor belt is longer than said hold down belt so that said conveyor belt extends beyond ends of said hold down belt to form inlet and discharge sections generally adjacent opposite ends of said hold down belt, and means for feeding parts to be deflashed to the inlet section of said conveyor belt.

4. The shot blast machine according to claim 3 further including a support frame for supporting said hold down belt and movable mounting means movably mounting said support frame so that said support frame can move upward and downward relative to said conveyor belt.

5. The shot blast machine according to claim 4 wherein said support frame is pivotally mounted to said movable mounting means, said movable mounting means including at least one carrier arm supporting said support frame.

6. The shot blast machine according to claim 5 wherein ends of said hold down belt are independently movable upward and downward relative to said conveyor belt.

7. A shot blast machine for deflashing plastic molded parts comprising:

conveyor means for delivering parts to be deflashed, shot blast means located above said conveyor means for impelling particles downwardly into deflashing engagement with parts on said conveyor means, mounting means providing an endless wire mesh belt means above said conveyor means and below said shot blast means to retain parts on said conveyor during deflashing, frame means supporting said wire mesh belt member on said mounting means for up and down floating movement above said conveyor means for engaging parts of different sizes on said conveyor means so as to retain the parts on the conveyor.

8. A shot blast machine for deflashing plastic parts comprising:

first conveyor means including a first endless belt being pivotable about ends thereof at a first speed, said conveyor means for delivering parts to be deflashed, shot blast means for propelling a blasting media toward the parts to be deflashed; and second conveyor means including a second endless belt located between said first conveyor means and said shot blast means, said second conveyor means adapted to permit said blasting media to pass through said second endless belt and impart a part on said first conveyor means, said second endless belt of said second conveyor means being synchronized to rotate about ends thereof at said first speed, said second conveyor means being biased toward said first conveyor means and being mounted for movement away from said first conveyor means as a result of parts being located therebetween.

* * * * *